US007785132B2

(12) United States Patent
Muller et al.

(10) Patent No.: US 7,785,132 B2
(45) Date of Patent: Aug. 31, 2010

(54) TERMINAL BLOCK FOR TELECOMMUNICATIONS AND DATA ENGINEERING

(75) Inventors: Manfred Muller, Berlin (DE); Harald Klein, Berlin (DE); Heiko Neumetzler, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/301,489

(22) PCT Filed: Apr. 26, 2007

(86) PCT No.: PCT/EP2007/003672

§ 371 (c)(1),
(2), (4) Date: Nov. 19, 2008

(87) PCT Pub. No.: WO2007/134696

PCT Pub. Date: Nov. 29, 2007

(65) Prior Publication Data

US 2009/0130920 A1 May 21, 2009

(30) Foreign Application Priority Data

May 19, 2006 (DE) ..... 10 2006 024 681

(51) Int. Cl.
*H01R 4/24* (2006.01)

(52) U.S. Cl. ..... 439/404; 439/402

(58) Field of Classification Search ..... 439/402–405, 439/709; 361/118, 119

See application file for complete search history.

(56) References Cited

U.S. PATENT DOCUMENTS

| | | | | |
|---|---|---|---|---|
| 7,037,118 | B2 * | 5/2006 | Neumetzler et al. | 439/404 |
| 2007/0064373 | A1 | 3/2007 | Neumetzler et al. | |

FOREIGN PATENT DOCUMENTS

| | | |
|---|---|---|
| AU | 610845 | 3/1989 |
| AU | 612822 | 7/1991 |
| DE | 298 02 727 | 5/1998 |
| DE | 102 36 114 | 10/2003 |
| DE | 102 57 308 | 7/2004 |
| DE | 103 17 621 | 11/2004 |
| EP | 0 308 635 | 3/1989 |
| GB | 2 129 628 | 5/1984 |
| GB | 2 337 872 | 12/1999 |
| WO | WO 2004/093275 A1 | 10/2004 |

* cited by examiner

*Primary Examiner*—Tho D Ta
(74) *Attorney, Agent, or Firm*—Merchant & Gould P.C.

(57) ABSTRACT

The invention relates to a connecting strip (1) for telecommunications and mid-range communications technology, comprising a housing (2) and at least two contact elements (11), wherein the contact element (11) comprises a first contact (12) for the connection of wires or cables and a second contact (13) for contacting a printed circuit board, the second contact (13) taking the form of a press-fit pin contact or a tuning-fork contact, and in which the first contact (12) is aligned towards the upper side (3) of the housing (2), and the second contact (13) is aligned towards the underside (4) of the housing (2), the first contacts (12) being arranged laterally offset from the longitudinal axis (L) of the housing (2), and on the opposite side at least one fin (8) being arranged so that between the first contacts (12) and the fin (8) a trench (9) is formed, the contact element (11) being constructed with a bracket (15) positioned above the second contact (13), aligned towards the upper side (3) of the housing (2), and arranged underneath the trench (9).

8 Claims, 4 Drawing Sheets

TERMINAL BLOCK FOR TELECOMMUNICATIONS AND DATA ENGINEERING

This application is a National Stage Application of PCT/EP2007/003672, filed 26 Apr. 2007, which claims benefit of Ser. No. 10 2006 024 681.0, filed 19 May 2006 in Germany and which application(s) are incorporated herein by reference. To the extent appropriate, a claim of priority is made to each of the above disclosed applications.

BACKGROUND OF THE INVENTION

The invention relates to a terminal block for telecommunications and data engineering for making contact with a printed circuit board.

Terminal blocks for making contact with a printed circuit board generally comprise a housing, in which contact elements are arranged, the contact elements comprising a first contact for the connection of wires or lines and a further contact for making contact with a printed circuit board. The further contacts in this case may be in the form of, for example, a soldering pin, a press-in pin or in the form of a fork contact. In the case of the two lastmentioned types of contact, in each case the connection needs to be produced by means of a mechanical force acting on the terminal block. Such a mechanical force being applied always has the risk associated with it of the terminal block being impaired.

SUMMARY OF THE INVENTION

The invention is therefore based on the technical problem of providing a terminal block for making contact with a printed circuit board, where, despite the mechanical force applied, the risk of any effects on the terminal block is minimized.

In this regard, the terminal block for telecommunications and data engineering comprises a housing and at least two contact elements, the contact element comprising a first contact for the connection of wires or lines and a second contact for making contact with a printed circuit board, the second contact being in the form of a press-in pin contact or in the form of a fork contact, the first contact being oriented towards the upper side, and the second contact being oriented towards the underside of the housing, the first contacts being arranged such that they are laterally offset with respect to the longitudinal axis of the housing, and at least one rib being arranged on the opposite side such that a trench is formed between the first contacts and the rib, the contact element being formed with a lug, which, above the second contact, is oriented towards the upper side of the housing and is arranged beneath the trench. As a result, the trench forms a defined pressure surface, a force effect, for example by means of a tool, being exerted on the surface of the trench, on the lug and the second contact arranged therebeneath. No force therefore needs to be exerted on the first contacts and their domes which are present, for example, which could lead, for example, to the plastic housing being impaired, either by the plastic being deformed or breaking off or because the first contacts could bore into the housing. This is prevented effectively by the defined pressure surface, the lug preferably being in a direct line of force with respect to the second contact. In this case, first and second contacts and the lug are preferably of integral design.

In one preferred embodiment, the contact element comprises a third contact, which is in the form of a fork contact, is oriented towards the upper side and is arranged beneath the rib, the rib being formed with insertion openings for an overvoltage protection plug or an overvoltage protection mounting rack. As an alternative or in addition, the third contact may also be used as a measuring tap or as a monitor access point. In this case, depending on the requirement, another type of contact may also be selected in place of a fork contact.

In one further preferred embodiment, the terminal block comprises at least one earthing contact element, the earthing contact element comprising a first contact, which is oriented towards the upper side of the housing, and at least one second contact, which is oriented towards the underside of the housing.

It is then possible for the ground connection from the surge arresters, via the printed circuit board, to a ground potential to be connected through via this earthing contact element. In this case, the terminal block preferably has two earthing contact elements.

In one further preferred embodiment, the second contact of the earthing contact element is in the form of a press-in pin contact or in the form of a fork contact, whereas the first contact is preferably in the form of a fork contact.

In one further preferred embodiment, the first contact of the contact element is in the form of an insulation displacement contact, further preferably the cutting edges being spread out at an angle of 45°.

Further preferably, the first contact of the earthing contact element is higher than the third contact of the contact elements in terms of their contact region, with the result that, when an overvoltage protection plug or an overvoltage protection mounting rack is inserted, the ground connection is first produced before the surge arresters make electrical contact with the wires via the third or first contacts.

In one further preferred embodiment, the surge arresters are arranged on a printed circuit board, said surge arresters preferably being arranged in two rows, in one row the longitudinal axis of the surge arresters being oriented parallel to a side edge of the printed circuit board and, in the other row, being oriented parallel to an upper edge of the printed circuit board. In this case, ribs are preferably arranged in the housing of the mounting rack, which ribs prevent any uncontrolled movement of the surge arresters after tripping.

In order to further stabilize the terminal block on the printed circuit board, further plastic pins may be provided, which are preferably parallel to the second contacts of the contact element.

BRIEF DESCRIPTION OF THE DRAWINGS

The invention will be explained in more detail below with reference to a preferred exemplary embodiment. In the figures:

FIG. 9 shows a perspective illustration of the terminal block with an overvoltage protection mounting rack plugged on.

DETAILED DESCRIPTION OF THE PREFERRED EMBODIMENTS

Figure 1:
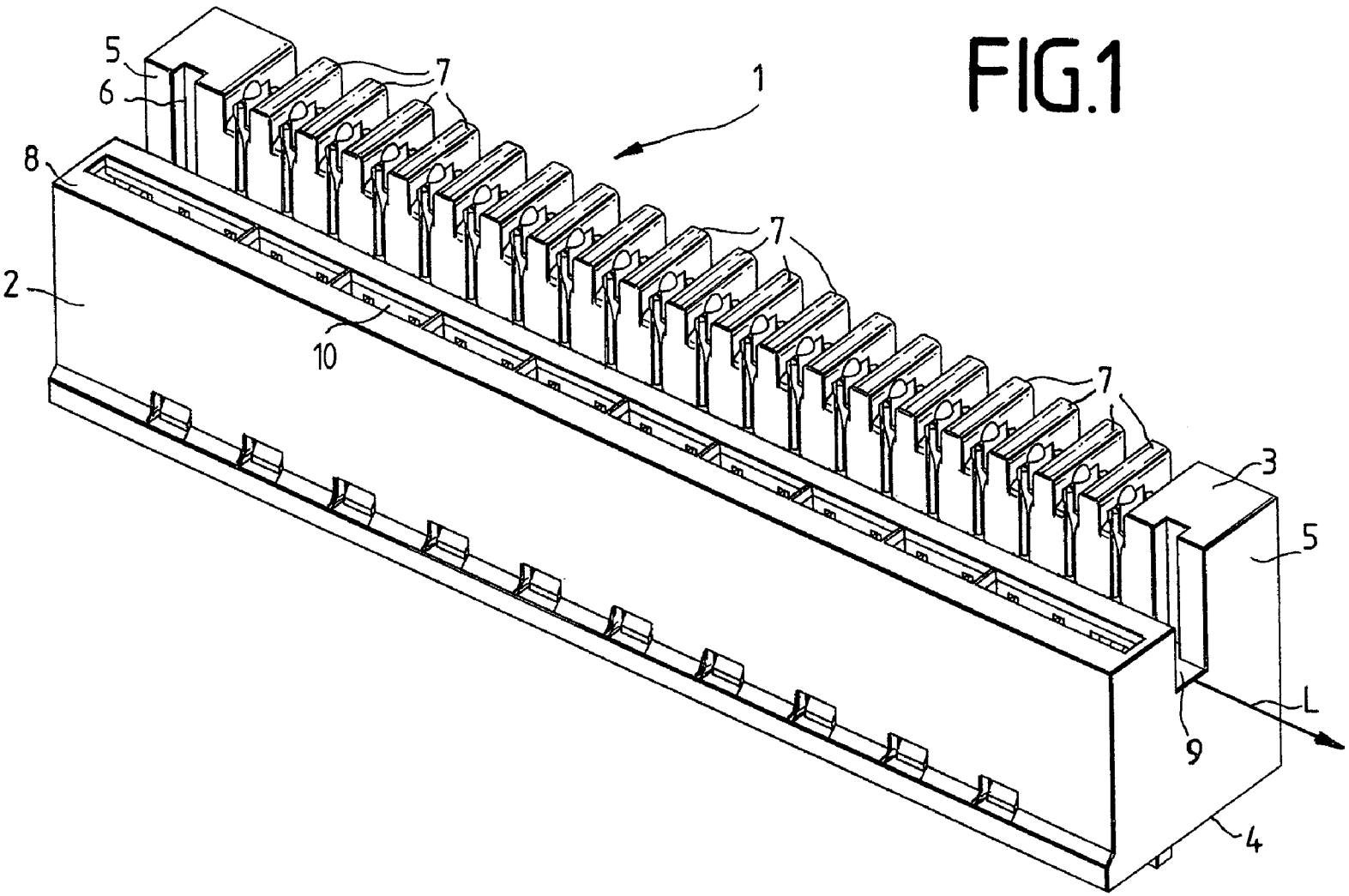
FIG. 1 shows a perspective illustration of a terminal block.
Figure 2:
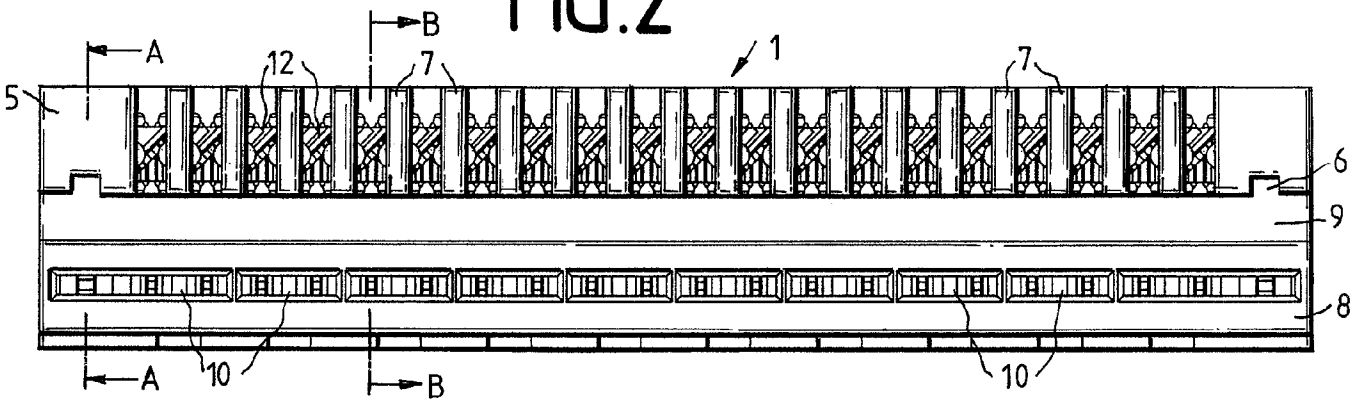
FIG. 2 shows a plan view of the terminal block.
Figure 3:
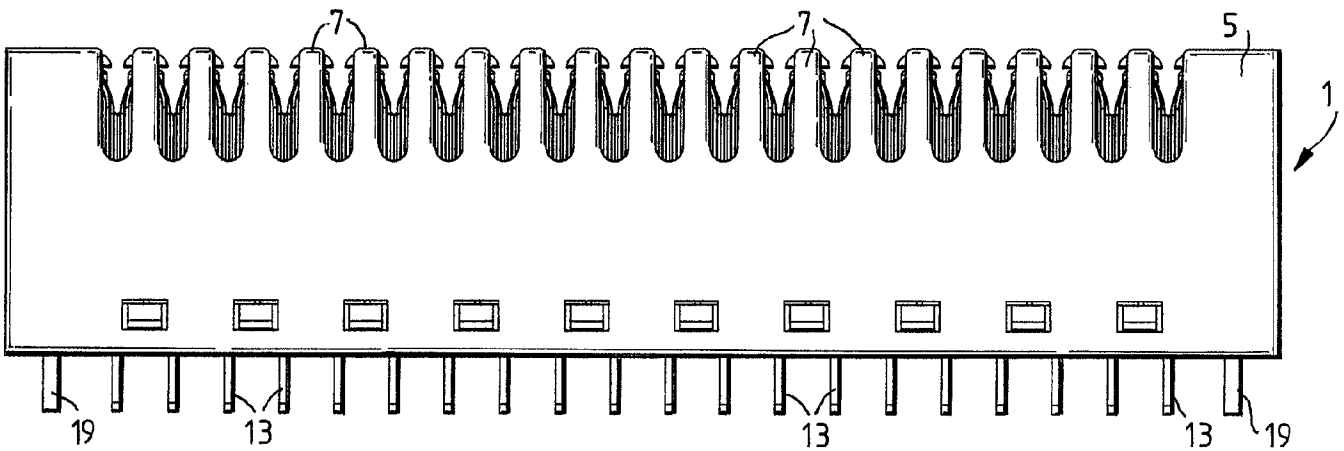
FIG. 3 shows a rear view of the terminal block.

FIG. 1 illustrates a terminal block 1, which comprises a preferably two-part housing 2. The housing 2 has an upper side 3 and an underside 4. Two parallelepipeds 5 with groove-like depressions 6 are arranged on the upper side 3, domes 7 being arranged between said parallelepipeds. The parallelepipeds 5 and the domes 7 are in this case arranged such that they are offset laterally with respect to the longitudinal axis L of the terminal block 1. A rib 8 is arranged on the upper side 3 on the opposite side, with the result that a trench 9 is formed between the parallelepipeds 5 and the domes 7 and the rib 8, said trench 9 being virtually in the form of a U, the height of the rib 8 being slightly smaller than that of the parallelepipeds 5 and the domes 7. The rib 8 is formed with insertion openings 10, whose function will be explained in more detail later.

Figure 4A:
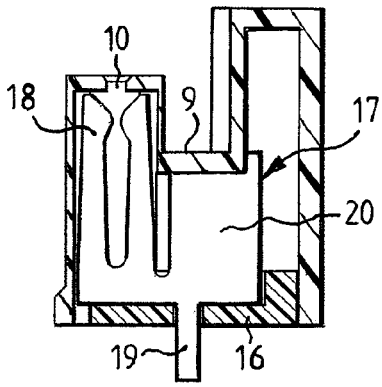
FIG. 4*a* shows a cross section along the section line A-A from FIG. 2.
Figure 4B:
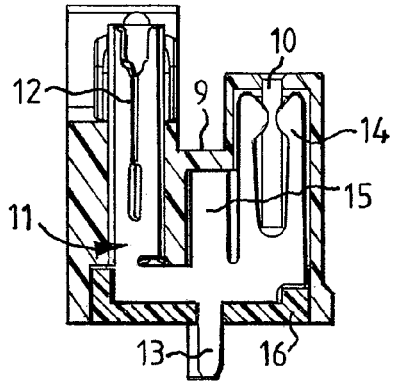
FIG. 4*b* shows a cross section along the section line B-B from FIG. 2.
Figure 5:
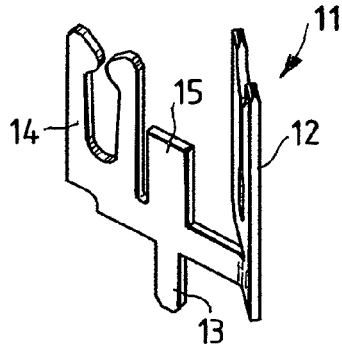
FIG. 5 shows a perspective illustration of a contact element.

Contact elements 11, which are of integral design, are arranged in the housing 2, one contact element being illustrated in FIG. 5. The contact element 11 comprises a first contact 12, which is in the form of an insulation displacement contact, a second contact 13, which is in the form of a press-in pin contact, and a third contact 14, which is in the form of a fork contact. In this case, the first and third contacts 12, 14 are oriented towards the upper side 3 of the housing 2 in the inserted state, whereas the second contact 13 is oriented towards the underside 4. A lug 15 is arranged over the second contact 13. There is a cutout between the lug 15 and the third contact 14, with the result that the third contact 14, but also the second contact 13, may be slightly resilient and can therefore compensate for, for example, certain tolerances. The lug 15 is preferably arranged centrally with respect to the second contact 13. If the contact element 11 is now pushed into the housing 2 from below, the first contact 12 is positioned between two domes 7, and the third contact 14 is positioned beneath the insertion slot 10, whereas the lug 15 is positioned beneath the trench 9. Once the contact elements 11 have been inserted, for example, a lower part 16 (see FIG. 4*a* and FIG. 4*b*) is then latched on in order to support the contact elements 11, the second contacts 13 protruding through the lower part 16 in order to be plugged into holes in a printed circuit board (not illustrated). In addition to the contact elements 11, two earthing contact elements 17 are also arranged in the terminal block 1, said earthing contact elements 17 preferably having a greater diameter than the second contacts 13 of the contact elements 11. The earthing contact elements 17 are in this case arranged in the region of the parallelepipeds 5. As can be seen in FIG. 4*a*, the earthing contact element 17 comprises a first contact 18, which is oriented towards the upper side and is in the form of a fork contact, and a second contact 19, which is in the form of a press-in pin contact and passes through the lower part 16. A wide lug 20 supports the earthing contact element 17, there being a cutout between the lug 20 and the first contact 18. In a corresponding manner, the position of the contact element 11 in the housing can be seen FIG. 4.

If it is now intended for the terminal block 1 to be pressed on to a printed circuit board (not illustrated), a force can be exerted via the trench 9, which forms a defined pressure surface, said force being transmitted directly to the second contacts 13 without this leading to any torsion, deformation of the plastic or the contacts 12 penetrating the plastic housing. In the process, the rib 8 is pulled up such that it acts as a stop edge for a connection tool of the insulation displacement contacts and therefore prevents any connection from the incorrect side.

Figure 6:
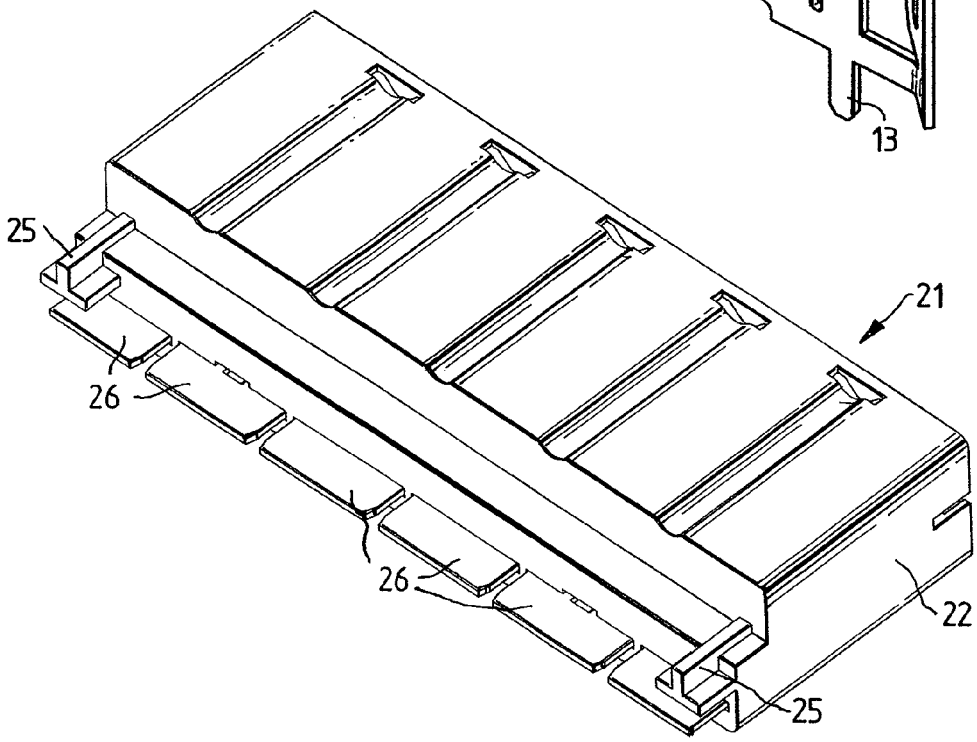
FIG. 6 shows a perspective illustration of an overvoltage protection mounting rack.
Figure 7:
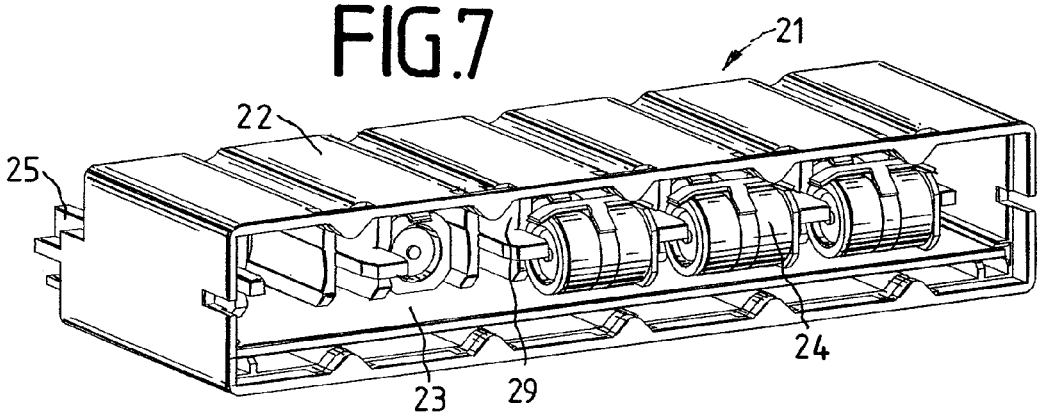
FIG. 7 shows a perspective illustration of the overvoltage protection mounting rack without a cover.
Figure 8:
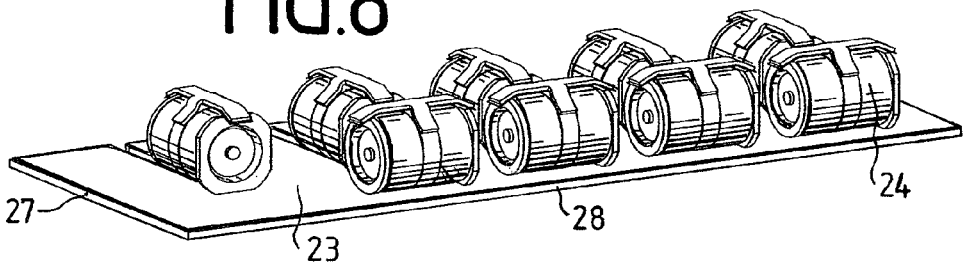
FIG. 8 shows a perspective illustration of a printed circuit board with surge arresters.

FIG. 6 illustrates an overvoltage protection mounting rack 21. The overvoltage protection mounting rack 21 comprises a housing 22, in which a printed circuit board 23 (see FIGS. 7 and 8) with surge arresters 24 is arranged. In this case, a three-pole surge arrester 24 is used in each case for protecting a twin wire. In order to mechanically connect the overvoltage protection mounting rack 21 to the terminal block, the housing 22 has web-shaped ribs 25, which enter into a tongue-and-groove connection with the groove-shaped depressions 6. The printed circuit board 23 has recesses on one side, with the result that insertion tongues 26 are formed which are correspondingly metal-plated in order to enter into an electrical connection with the third contacts 14 of the contact elements 11. Then, the wires to be connected are connected to the surge arresters via the first contacts 12. In a corresponding manner, the ground connections of the surge arresters 24 are also combined on the printed circuit board 23 and connected to the contacts 18 of the earthing contact element 17 via the outer insertion tongues 26. As can now be seen in FIG. 8, the surge arresters 24 are arranged in two rows, in one row the longitudinal axis of the surge arresters 24 being oriented parallel to a side edge 27 of the printed circuit board 23 and, in the other row, being oriented parallel to an upper edge 28 of the printed circuit board 23. In order now to prevent a surge arrester 24 from moving in an undefined manner in the housing 22 once it has been released, the housing 22 is formed with ribs 29, which hold the surge arresters 24 in a defined position.

Figure 9:
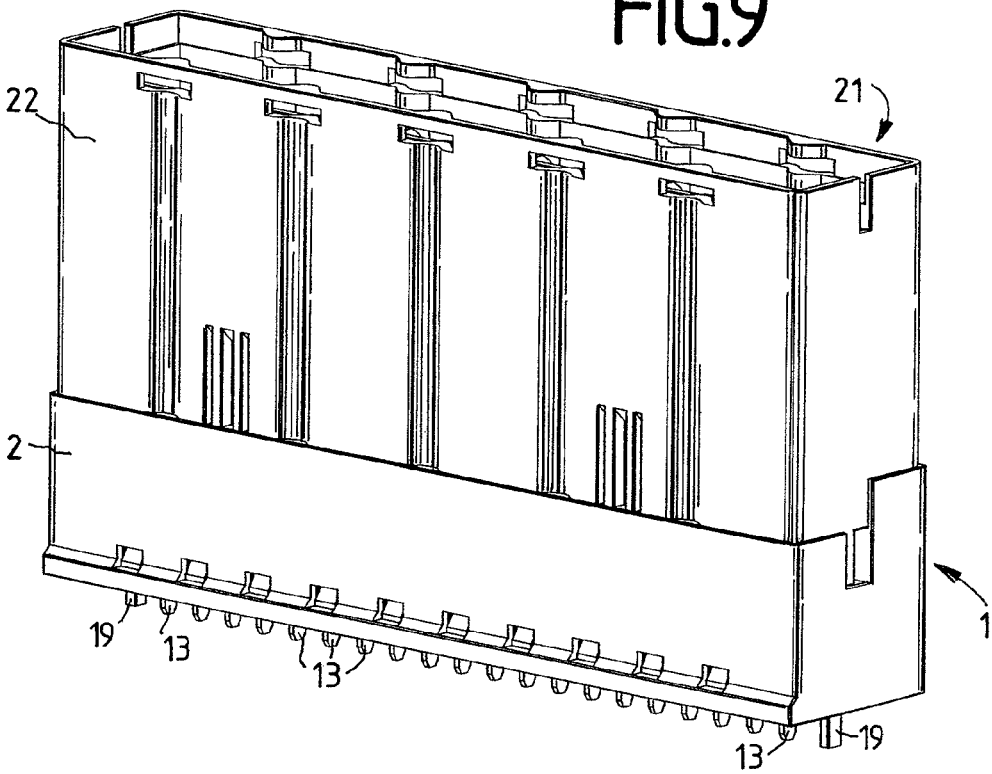

Finally, a terminal block 1, which is connected to the overvoltage protection mounting rack 21, is illustrated in FIG. 9.

LIST OF REFERENCE SYMBOLS

1 Terminal block
2 Housing
3 Upper side
4 Underside
5 Parallelepiped
6 Depression
7 Dome
8 Rib
9 Trench
10 Insertion opening
11 Contact element
12 Contact
13 Contact
14 Contact
15 Lug
16 Lower part
17 Earthing contact element
18 Contact
19 Contact
20 Lug
21 Overvoltage protection mounting rack
22 Housing
23 Printed circuit board
24 Surge arrester
25 Rib
26 Insertion tongue
27 Side edge
28 Upper edge
29 Rib

The invention claimed is:

1. A terminal block for telecommunications and data engineering, comprising:

a housing having an upper side and an underside;

at least two contact elements, each contact element comprising a first contact for connection of wires or lines and a second contact for making contact with a printed circuit board, the second contact of each contact element being a press-in pin contact or a fork contact, the first contact of each contact element being oriented towards the upper side of the housing, and the second contact being oriented towards the underside of the housing, the first contacts being arranged such that they are laterally offset with respect to a longitudinal axis of the housing; and at least one rib being arranged on an opposite side of the longitudinal axis of the housing from the first contacts such that a trench is formed between the first contacts and the rib, each contact element being formed with a lug, which is above the second contact, is oriented towards the upper side of the housing, and is arranged beneath the trench.

2. The terminal block as claimed in claim 1, wherein the contact elements comprise third contacts, which are fork contacts, are oriented towards the upper side of the housing, and are arranged beneath the rib, the rib being formed with insertion openings for an overvoltage protection plug or an overvoltage protection mounting rack.

3. The terminal block as claimed in claim 1, wherein the terminal block comprises at least one ground contact element, the ground contact element comprising a first contact, which is oriented towards the upper side of the housing, and at least one second contact, which is oriented towards the underside of the housing.

4. The terminal block as claimed in claim 3, wherein the second contact of the ground element is a press-in pin contact or a fork contact.

5. The terminal block as claimed in claim 3, wherein the first contact of each ground contact element is a fork contact.

6. The terminal block as claimed in claim 1, wherein the first contacts of the contact elements are insulation displacement contacts.

7. The terminal block as claimed in claim 2, further comprising an overvoltage protection mounting rack wherein surge arresters of the overvoltage protection mounting rack are arranged on a printed circuit board.

8. The terminal block as claimed in claim 7, wherein the surge arresters are arranged in two rows, a longitudinal axis of the surge arresters in one of the rows being oriented parallel to a side edge of the printed circuit board and, a longitudinal axis of the surge arresters in the other of the rows being oriented parallel to an upper edge of the printed circuit board.

* * * * *